United States Patent [19]

Sawa et al.

[11] 4,281,268

[45] Jul. 28, 1981

[54] X-RAY TUBE WITH COOLED SHIELD BETWEEN TARGET AND ROTOR

[75] Inventors: Tsuna Sawa, Fujisawa; Yashunori Ishii, Chigasaki, both of Japan

[73] Assignee: Tokyo Shibaura Denki Kabushiki Kaisha, Kawasaki, Japan

[21] Appl. No.: 1,825

[22] Filed: Jan. 8, 1979

[30] Foreign Application Priority Data

Jan. 18, 1978 [JP] Japan ..... 53/3795

[51] Int. Cl.[3] ..... H01J 35/04

[52] U.S. Cl. ..... 313/60

[58] Field of Search ..... 313/60, 55; 250/520

[56] References Cited

U.S. PATENT DOCUMENTS

| | | | |
|---|---|---|---|
| 2,345,723 | 4/1944 | Atlee et al. | 313/60 |
| 2,679,608 | 5/1954 | Cordingly | 313/60 |
| 2,885,582 | 5/1959 | Bell | 313/55 |
| 3,500,097 | 3/1970 | Perry et al. | 313/59 |
| 3,882,339 | 5/1975 | Rate et al. | 313/60 |
| 3,916,202 | 10/1975 | Heiting et al. | 250/403 |

FOREIGN PATENT DOCUMENTS

| | | | |
|---|---|---|---|
| 619561 | 9/1935 | Fed. Rep. of Germany | 313/60 |
| 646275 | 11/1950 | United Kingdom | 313/60 |
| 803165 | 10/1958 | United Kingdom | 313/60 |

*Primary Examiner*—Robert Segal

*Attorney, Agent, or Firm*—Cushman, Darby & Cushman

[57] ABSTRACT

An X-ray tube comprising an evacuated envelope, a cathode unit disposed in the evacuated envelope and an anode unit disposed in the evacuated envelope to face the cathode unit. The envelope consists of end portions made of glass and an intermediate portion made of metal. The anode unit has a target attached to a rotor. The X-ray tube further comprises a heat-insulating member provided between the target and the rotor for preventing the rotor from being heated by heat radiating from the target. The heat-insulating member constitutes a part of the evacuated envelope.

12 Claims, 6 Drawing Figures

X-RAY TUBE WITH COOLED SHIELD BETWEEN TARGET AND ROTOR

BACKGROUND OF THE INVENTION

This invention relates to an X-ray tube.

As shown in FIG. 1, a known X-ray tube of large capacity having a rotary anode comprises an evacuated envelope 1, a cathode unit 2 disposed in the envelope 1, and an anode unit 3 disposed in the envelope 1 to face the cathode unit 2. The evacuated envelope 1 consists of end portions 1*a* and 1*c* made of glass and an intermediate portion 1*b* made of metal. The anode unit 3 includes a target 4 facing the cathode unit 2 and a rotor 6 for rotating the target 4. The X-ray tube further comprises a stator 7 for rotating the rotor 6 and an insulation hollow cylinder 8 for insulating the rotor 6 from the stator 7. The cathode unit 2 has a cup 9 containing a filament for emitting an electron beam.

An electron beam from the filament hits the target 4, thereby generating X-rays. The X-rays are emitted outside through a window 10 provided on the evacuated envelope 1. As X-rays are generated, the target 4 is heated to a high temperature. The heat of the target 4 mostly radiates from the surface of the target 4 and partly is transmitted to the rotor 6 through a shaft 5 connecting target 4 to the rotor 6. As a result, the rotor 6 is heated mostly by the heat radiating from the target 4 and partly by the heat transmitted via the shaft 5. As it is heated more and more, the rotor 6 operates less efficiently for the following reasons.

As shown in FIG. 2, the rotor 6 comprises a rotor-cylinder 11, a shaft 12 extending in the rotor-cylinder 11 and attached at the upper end to the rotor-cylinder 11 by means of a screw, a pair of bearings 13 provided the upper and lower end portions of the shaft 12, respectively, and a support 14 disposed in the rotor-cylinder 11 and surrounding the bearings 13. As mentioned above, the heat of the target 4 mostly radiates to the rotor 6 and partly is transmitted to the rotor 6 via the shaft 5. As the rotor 6 is heated gradually, so is the shaft 12 in the rotor-cylinder 11. Ultimately, the bearings 13 are heated gradually, too. The heat of the bearings 13 is transmitted to the support 14, and it is emitted outside the rotor 6. Here occurs a temperature difference between the inner and outer races of each bearing 13. Generally, a uniform clearance of a few microns is provided between the races and ball of bearing 13 to achieve a smooth rotation of the rotor 6. A smooth rotation of the rotor 6 would be impossible if the bearings 13 thermally expand due to the temperature difference between the inner and outer races of the bearings 13.

Further, the known X-ray tube of FIG. 1 is defective in the following respect. When impinged with an electron beam, the target 4 emits secondary electrons. The secondary electrons hit the evacuated envelope 1 so hard that the end portions of the envelope 1, both made of glass, are broken in some cases.

SUMMARY OF THE INVENTION

An object of this invention is to provide an X-ray tube wherein heat is not transmitted from a target directly to a rotor and the portions of an evacuated envelope, made of glass, are never broken by secondary electrons from the target or by stray electrons from a cathode.

DETAILED DESCRIPTION OF THE PREFERRED EMBODIMENTS

Figure 2:
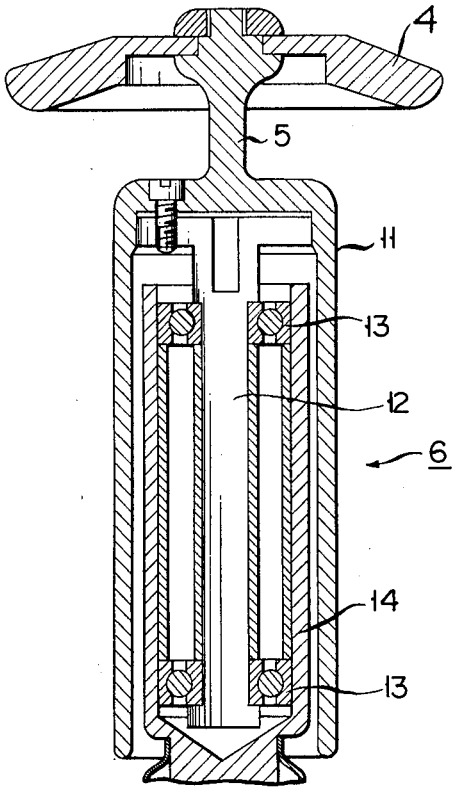
FIG. 2 PRIOR ART
FIG. 2 is a cross sectional view of the rotor of the X-ray tube shown in FIG. 1, with a target attached to it.
Figure 3:
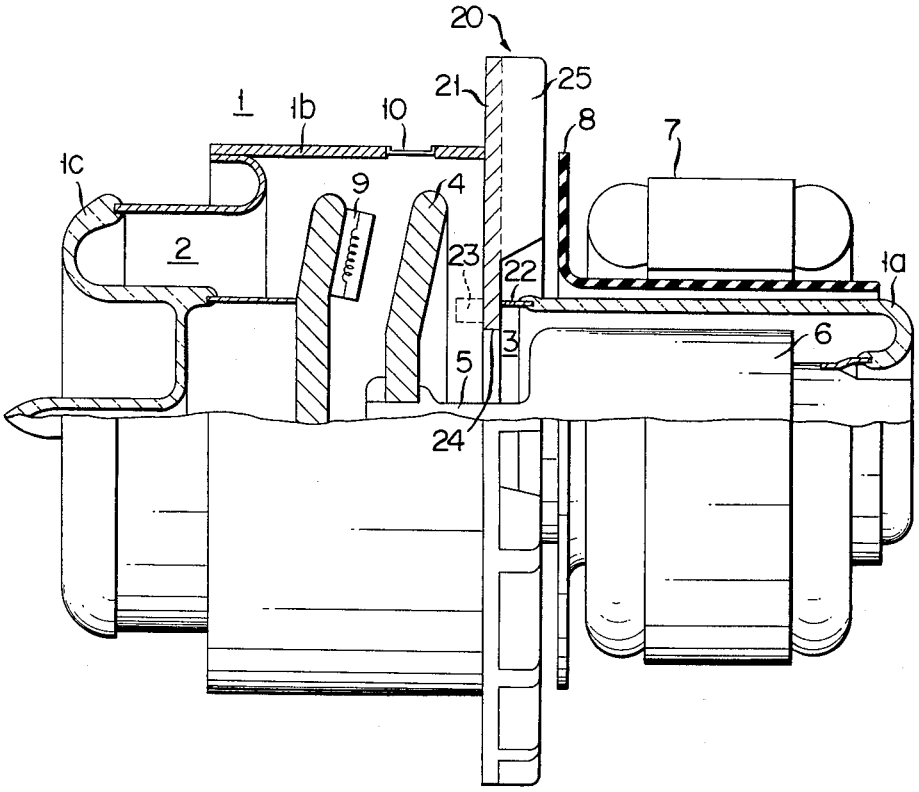
FIG. 3 is a partially cross sectional view of an X-ray tube according to this invention.

Now referring to FIG. 3, and X-ray tube according to this invention will be described. The X-ray tube is similar in large part to the X-ray tube illustrated in FIG. 1 with respect to construction. The same and similar parts are therefore denoted by the same or like reference numerals as used in FIGS. 1 and 2.

Figure 1:
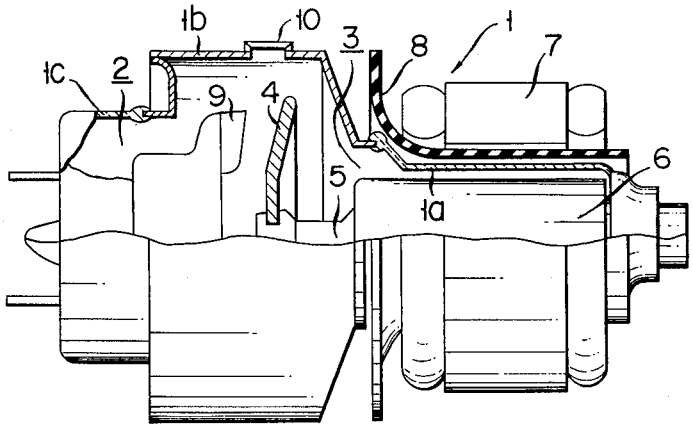
FIG. 1 PRIOR ART
FIG. 1 is a partially cross sectional view of a known X-ray tube.

Like the tube of FIG. 1, the X-ray tube comprises an evacuated envelope 1 consisting of end portions 1*a* and 1*c* made of glass and an intermediate portion 1*b* made of metal; a cathode unit 2 having a cup and disposed in the envelope 1; an anode unit 3 disposed in the envelope 1 to face the cathode unit 2 and constituted by a target 4 facing the cathode unit 2 and a rotor 6 for rotating the target 4; a stator 7 for rotating the rotor 6; and a hollow insulation cylinder 8 for insulating the rotor 6 from the stator 7. The cup 9 of the cathode unit 2 contains a filament for emitting an electron beam.

Figure 4:
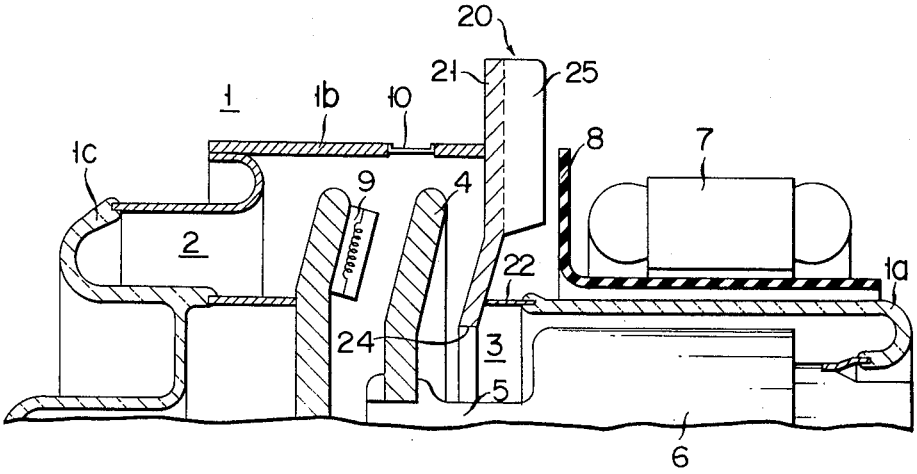
FIG. 4 shows a modification of the envelope of the X-ray tube illustrated in FIG. 3.

The X-ray tube further comprises a ring member 21 provided between the target 4 and the rotor 6 and arranged coaxially with them. Thus, a shaft 5 extends through the central hole of the ring member 21 to connect the target 4 to the rotor 6. The ring member 21 is secured at the outer peripheral portion to one end of the intermediate metal portion 1*b* of the evacuated envelope 1 and at the inner peripheral portion to a metal ring 22 fused with one end of the end portion 1*a* of the evacuated envelope 1. The ring member 21 is made of a flat disc with a central hole 24. Instead, the ring member 21 may have its inner peripheral portion bent toward the target 4 as illustrated in FIG. 4. In this case it is preferred, from an electrical point of view, that the inner peripheral portion should be positioned halfway between the target 4 and the rotor 6. Further, the ring member 21, if made of a flat disc with a central hole 24, may be provided with at least one projection 23 protruding from its inner peripheral portion toward the cup 9 of the cathode unit 2.

The hole 24 of the ring member 21 may be eccentric with the shaft 5 connecting the target 4 to the rotor 6. If this is the case, the center of the hole 24 is positioned farther than the axis of the shaft 5, away from the cup 9 of the cathode unit 2. The diameter of the hole 24 is either equal to that of the rotor 6 or smaller. Preferably the hole 24 should be large enough to permit the shaft 5 to pass loosely through it.

Figure 5:
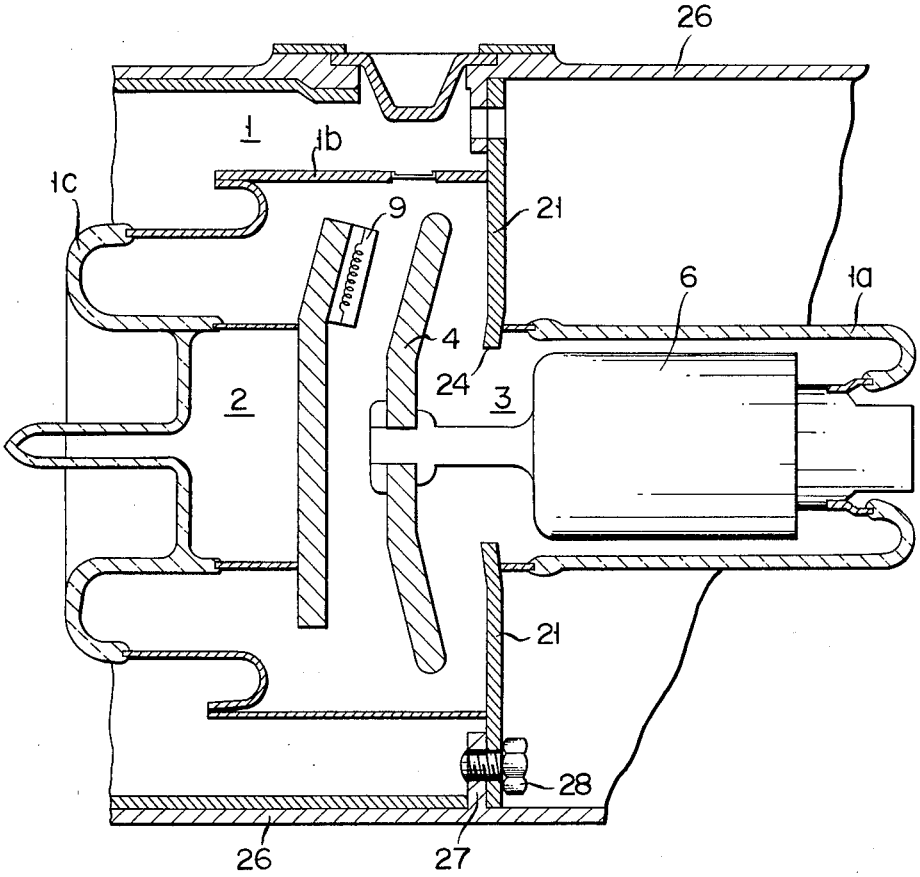
FIG. 5 is a cross sectional view of the main part of the X-ray tube shown in FIG. 3, attached to an X-ray tube housing.

The ring member 21 is made of a material having a good thermal conductivity, such as copper. At least one of its sides which faces the target 4 is blackened, using copper sulfide, black chromium or the like. On the side facing the rotor 6 the ring member 21 may have a plurality of heat-radiating fins 25. Further, the ring member 21 may be made so long that its outer peripheral portion extends outside the evacuated envelope 1 and secured to a housing 26 for the X-ray tube by means of bolt-nut assemblies 28, as illustrated in FIG. 5.

The insulation cylinder 8 is so shaped and positioned as to surround the end portion 1*a* which surrounds the rotor 6 and to cover the exposed side of the ring member 21 which extends from the end portion 1*a*. Into the gap between the cylinder 8 and end portion 1*a* and then between the cylinder 8 and the ring member 21 a cooling medium is introduced to cool the rotor 6 and the ring member 21. To supply the cooling medium and to make the same circulate in said gap, a pipe (not shown) is connected to the insulation cylinder 8 at one end and to a source of cooling medium (not shown). As the cooling medium, an insulative gas, for example, sulfur hexafluoride ($SF_6$) or an insulative oil is used.

Figure 6:
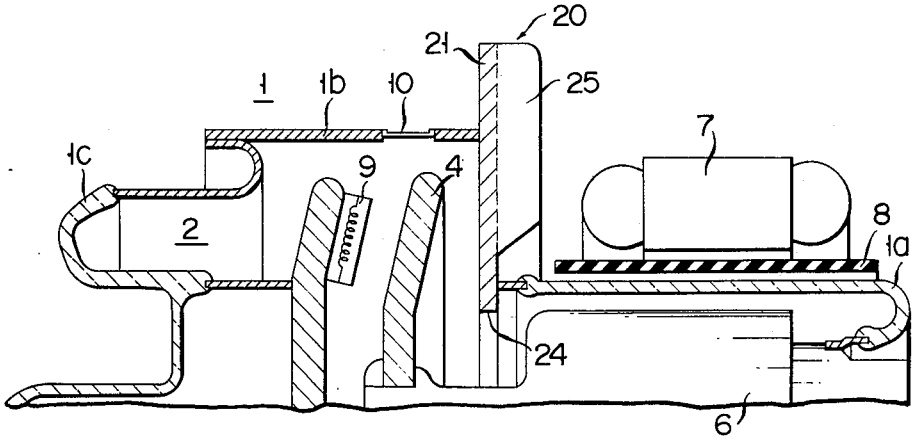
FIG. 6 shows a modification of the hollow insulation cylinder of the X-ray tube shown in FIG. 3.

The insulation cylinder 8 may instead be so shaped as shown in FIG. 6. It surrounds only the end portion 1*a*, thereby electrically insulating the rotor 6 from the stator 7.

As described above, the ring member 21 shuts the heat radiating from the target 4. Thus, except for the heat transmitted through the shaft 5, the heat of the target 4 is not transmitted directly to the rotor 6. As a result, the rotor 6 will never be heated to such extent that the bearings supporting the rotor shaft thermally expands to make impossible a smooth rotation of the rotor shaft. For this reason, the X-ray tube according to this invention can operate with a high efficiency and thus proves a very practical one.

What we claim is:

1. An X-ray tube comprising:

an evacuated envelope including first and second end portions made of glass and an intermediate portion made of metal, said first end portion having a smaller diameter than said intermediate portion;

a cathode unit disposed in said evacuated envelope;

an anode unit disposed in said evacuated envelope and including a target received in said intermediate portion and facing the cathode unit, a rotor disposed in said first end portion and a shaft interconnecting said target and said rotor;

a shielding ring made of a heat conductive material and connected to said intermediate portion at its outer peripheral portion and to said first end portion at its inner peripheral portion, thereby constituting a part of said envelope, the inner periphery of said shielding ring extending between said target and said rotor, thereby protecting said first end portion against electrons emitted from said target; and an insulation cylinder including a first section surrounding said first end portion and a second section adjacent to at least a portion of said shielding ring, said first and second sections, said shielding ring and said first end portion defining a region through which a cooling medium may flow to cool said shielding ring and first end portion.

2. An X-ray tube according to claim 1, wherein said shielding ring is includes a metal disc having a central hole through which said shaft extends.

3. An X-ray tube according to claim 2, wherein said metal disc is made of copper.

4. An X-ray tube according to claim 3, wherein said metal disc is blackened on the side which faces said target.

5. An X-ray tube according to claim 4, wherein said metal disc is provided with a plurality of heat-radiating fins on the other side of the metal disc.

6. An X-ray tube according to claim 1, wherein said heat-insulating member includes a metal disc having an eccentric hole.

7. An X-ray tube according to claim 2, wherein said metal disc is secured to one end of said intermediate portion at the outer peripheral portion and to a metal ring fused with one of the end portion at the inner peripheral portion.

8. An X-ray tube according to claim 7, wherein the inner peripheral portion of said metal disc is so bent toward said target as to be positioned halfway between the target and the rotor.

9. An X-ray tube according to claim 8, wherein the inner peripheral portion of said metal disc is so bent toward the target as to extend parallel to the outer peripheral portion of the target.

10. An X-ray tube according to claim 7, wherein the inner peripheral portion of said metal disc is provided with at least one projection extending toward the target.

11. An X-ray tube according to claim 7, wherein the outer peripheral portion of said metal disc extends outside said evacuated envelope and is secured to a housing for the X-ray tube.

12. An X-ray tube according to claim 11, wherein said metal disc defines a plurality of holes formed in its outer peripheral portion and which further comprises at least one bolt-nut assembly extending through at least one of said holes of the shielding ring and fastening the shielding ring to said evacuated envelope.

* * * * *